US009790854B2

(12) United States Patent
Sugiyama et al.

(10) Patent No.: US 9,790,854 B2
(45) Date of Patent: Oct. 17, 2017

(54) DEVICE FOR CONTROLLING IN-CYLINDER PRESSURE SENSOR

(71) Applicants: TOYOTA JIDOSHA KABUSHIKI KAISHA, Toyota-shi, Aichi-ken (JP); KABUSHIKI KAISHA TOYOTA JIDOSHOKKI, Kariya-shi, Aichi-ken (JP)

(72) Inventors: Kouseki Sugiyama, Shizuoka-ken (JP); Sho Sakurai, Kariya (JP)

(73) Assignees: Toyota Jidosha Kabushiki Kaisha, Toyoto-shi, Aichi-ken (JP); Kabushiki Kaisha Toyota Jidoshokki, Kariya-shi, Aichi-ken (JP)

( * ) Notice: Subject to any disclaimer, the term of this patent is extended or adjusted under 35 U.S.C. 154(b) by 245 days.

(21) Appl. No.: 14/663,483

(22) Filed: Mar. 20, 2015

(65) Prior Publication Data

US 2015/0275752 A1 Oct. 1, 2015

(30) Foreign Application Priority Data

Mar. 25, 2014 (JP) ..... 2014-062282

(51) Int. Cl.
*F02P 7/00* (2006.01)
*F02B 77/04* (2006.01)
(Continued)

(52) U.S. Cl.
CPC ..... *F02B 77/04* (2013.01); *F02D 35/024* (2013.01); *F02P 19/026* (2013.01); *F02P 19/028* (2013.01);
(Continued)

(58) Field of Classification Search
CPC ..... F02B 77/04; F02D 35/023; F02D 35/024; F02D 41/1466; F02P 19/026;
(Continued)

(56) References Cited

U.S. PATENT DOCUMENTS

2007/0227487 A1* 10/2007 Last ..... F23Q 7/001 123/145 A
2008/0067165 A1* 3/2008 Kern ..... F02P 19/028 219/267
(Continued)

FOREIGN PATENT DOCUMENTS

JP 2008-19827 1/2008
JP 2009-167817 A 7/2009
(Continued)

*Primary Examiner* — M. McMahon
*Assistant Examiner* — Tea Holbrook
(74) *Attorney, Agent, or Firm* — Finnegan, Henderson, Farabow, Garrett & Dunner, LLP

(57) ABSTRACT

When only smoke is generated, the sensor sensitivity is not substantially changed from the initial value. When both smoke and unburned HC are generated, the number of times the sensor sensitivity becomes lower than the initial value is increased. From these results, it can be understood that a deposit is formed in the presence of unburned HC and smoke existing simultaneously. The degree of reduction in sensor sensitivity becomes higher if the smoke concentration is increased when the unburned HC concentration condition is fixed. From this result, it can also be understood that while the coexistence of smoke and unburned HC is a prerequisite, unburned HC contributes largely to the formation of a deposit.

5 Claims, 6 Drawing Sheets

(51) Int. Cl.

| | |
|---|---|
| ***F02P 19/02*** | (2006.01) |
| ***F02D 35/02*** | (2006.01) |
| *F23Q 7/00* | (2006.01) |
| *F02D 41/14* | (2006.01) |

(52) U.S. Cl.
CPC ..... *F23Q 7/001* (2013.01); *F02D 35/023* (2013.01); *F02D 41/1466* (2013.01); *F02P 19/027* (2013.01); *F23Q 2007/002* (2013.01)

(58) Field of Classification Search
CPC . F02P 19/027; F02P 19/028; F23Q 2007/002; F23Q 7/001
See application file for complete search history.

(56) References Cited

U.S. PATENT DOCUMENTS

2008/0262699 A1* 10/2008 Hasegawa ..... F02D 35/023 701/103
2008/0296281 A1* 12/2008 Glock ..... F02P 19/028 219/260
2010/0058832 A1* 3/2010 Onishi ..... F01N 9/002 73/23.31
2012/0053818 A1* 3/2012 Sackmann ..... F02D 35/02 701/102
2014/0216145 A1* 8/2014 Hau ner ..... G01L 23/02 73/114.19
2015/0048066 A1* 2/2015 Maeda ..... F23Q 7/001 219/121.64
2015/0135798 A1* 5/2015 Ryll ..... F02D 41/28 73/1.59

FOREIGN PATENT DOCUMENTS

JP 2009203938 A * 9/2009
JP 2009-222031 10/2009
JP 4826962 B2 * 11/2011 ..... F02P 19/028

* cited by examiner

DEVICE FOR CONTROLLING IN-CYLINDER PRESSURE SENSOR

BACKGROUND OF THE INVENTION

Field of the Invention

The invention relates to a device for controlling an in-cylinder pressure sensor integrated with a glow plug.

Background Art

An in-cylinder pressure sensor integrated with a glow plug for detecting the pressure in a combustion chamber of an internal combustion engine is well known, which has a pressure receiving portion constituted by a heater of a glow plug incorporating a heat generating element. Japanese Patent Laid-Open No. 2009-222031 for example discloses, as a device for use with such an in-cylinder pressure sensor, a device that estimates the amount of deposit accumulated between a cylinder head and a pressure receiving portion in an internal combustion engine when the internal combustion engine is in a predetermined operating condition, and that energizes a heat generating element on the basis of the estimated amount of deposit. In this device, the amount of deposit is estimated on the basis of the amount of heat generated in the combustion chamber, the waveform of a signal from the in-cylinder sensor and the surface temperature of the heater.

When the amount of deposit accumulated between the cylinder bead and the pressure receiving portion is increased, there arises a problem of increase in sliding friction of the pressure receiving portion, which reduces the detection accuracy of the in-cylinder pressure sensor. The above-described device can energize the heat generating element on the basis of the estimated amount of deposit and can therefore decompose and remove any deposit accumulated between the cylinder head and the pressure receiving portion by increasing the temperature of the heater at a suitable time on the basis of the estimated amount of deposit.

Energization of the heat generating element is accompanied by consumption of electric power. It is, therefore, undesirable to frequently energize the heat generating element, even though the energization is performed for the purpose of decomposing and removing the accumulated deposit. In the art disclosed in Japanese Patent Laid-Open No. 2009-222031, the amount of accumulated deposit is indirectly estimated by using, for example, the amount of heat generated in the combustion chamber and the waveform of the signal from the in-cylinder pressure sensor for the amount of deposit, and the estimation accuracy is not always correct. There is therefore, a possibility of unnecessary energization of the heat generating element.

SUMMARY OF THE INVENTION

In view of the above-described problem, an object of the present invention is to provide an in-cylinder pressure sensor integrated with a glow plug in which a heat generating element is energized for the purpose of decomposing and removing a deposit accumulated in a combustion chamber, and in which the amount of accumulated deposit is estimated with improved accuracy.

According to a first aspect of the present invention, a device for controlling an in-cylinder pressure sensor is provided. The in-cylinder pressure sensor is integrated with a glow plug. The in-cylinder pressure sensor is provided for detecting the pressure in a combustion chamber of an internal combustion engine. The in-cylinder pressure sensor has a pressure receiving portion constituted by a heater incorporating a heat generating element. The device includes energization execution means and deposit amount estimation means. The energization execution means is configured to energize the heat generating element for the purpose of decomposing and removing an accumulated deposit when the amount of accumulated deposit in the combustion chamber is equal to or larger than a predetermined amount. The deposit amount estimation means is configured to estimate the amount of deposit by computing in each cycle of the internal combustion engine an amount of soot and an amount of unburned fuel generated by combustion in the combustion chamber, and by adjusting one of the amount of soot and the amount of unburned fuel with reference to the other.

According to a second aspect of the present invention, in the device according to the first aspect, the deposit amount estimation means may estimate the amount of deposit by adjusting the one of the computed amount of soot and the computed amount of unburned fuel larger in mass than the other so that the amount of soot and the amount of unburned fuel are equal in mass to each other.

According to a third aspect of the present invention, in the device according to the first aspect, the deposit amount estimation means may estimate the amount of deposit by adjusting the amount of soot so that the proportion of soot in the total mass of the amount of soot and the amount of unburned fuel is equal to or smaller than the proportion of unburned fuel.

According to a fourth aspect of the present invention, in the device according to the third aspect, the energization execution means may energize the heat generating element for the purpose of decomposing and removing unburned fuel in the accumulated deposit. The energization execution means may include energization amount setting means for setting an amount of energization energy to be put into the heat generating element during energization of the heat generating element. The energization amount setting means may set the amount of energization energy larger when the proportion of soot computed on the basis of the adjusted amount of soot is low than when the proportion of soot is high.

From a finding made by the inventors of the present invention, it has been made clear that major constituents of a deposit accumulated in a combustion chamber is soot and unburned fuel. A first aspect of the invention is based on this finding. In the first aspect of the invention, an amount of accumulated deposit can be directly estimated by computing amounts of major constituents generated and by adjusting the computed amounts of generated constituents. As a result, the heat generating element can be energized at an optimum time. That is, the power consumption accompanying decomposition and removal of the accumulated deposit can be minimized.

A second aspect of the invention is based on a finding that the masses of soot and unburned fuel contained in a deposit are equal to each other. In the second aspect of the invention, therefore, the amount of accumulated deposit can be estimated with improved accuracy.

A third aspect of the invention is based on a finding that while the coexistence of smoke and unburned fuel is prerequisite to the formation of a deposit, unburned fuel contributes largely to the formation of the deposit in comparison with soot. In the third aspect of the invention, therefore, the amount of accumulated deposit can be estimated with improved accuracy.

In a case where the amount of soot is adjusted so that the proportion of soot in the total mass of the amount of soot and the amount of unburned fuel is equal to or smaller than the proportion of unburned fuel, there is a possibility of the proportion of unburned fuel in the total mass being relatively high. If the proportion of unburned fuel is increased, larger energy is required for decomposition of unburned fuel. In a fourth aspect of the invention, in such a case, the amount of energization energy to be put into the heat generating element can be set larger when the proportion of soot is low than when the proportion of soot is high. As a result, unburned fuel can be decomposed with reliability even when the proportion of unburned fuel is increased.

DETAILED DESCRIPTION OF THE PREFERRED EMBODIMENTS

First Embodiment

A first embodiment of the present invention will be described with reference to FIGS. 1 to 4.

Description of System Configuration

Figure 1:
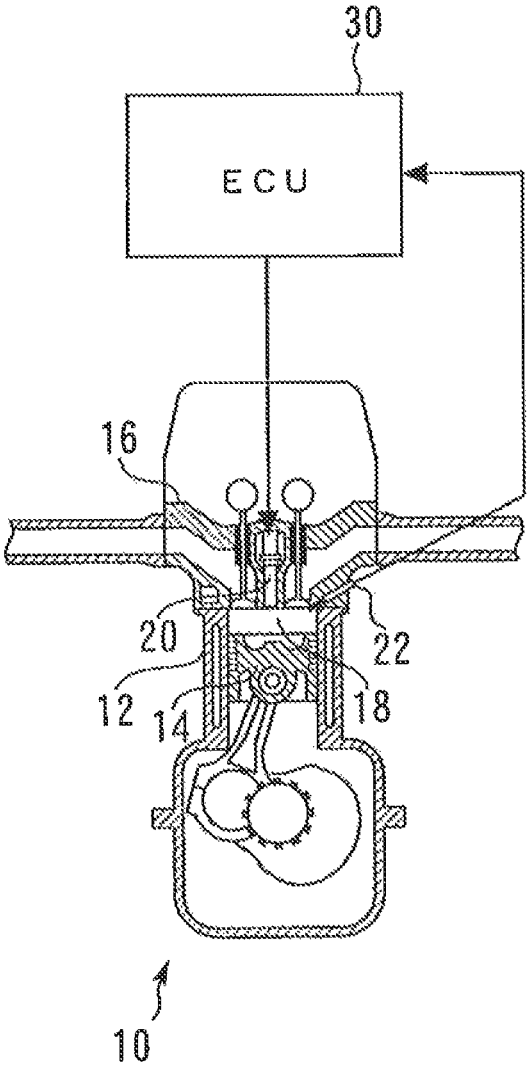
FIG. 1 is a diagram schematically showing a system configuration in first embodiment of the present invention.

FIG. 1 is a diagram schematically showing a system configuration in a first embodiment of the present invention. As shown in FIG. 1, a system in the present embodiment includes a diesel engine 10 provided as an internal combustion engine mounted on a vehicle or the like. In a cylinder 12 of the diesel engine 10, a piston 14 that slides in a cylinder 12 is provided. A cylinder head 16 is disposed above the cylinder 12. A combustion chamber 18 is defined by a bore wall surface of the cylinder 12, a top surface of the piston 14 and a bottom surface of the cylinder head 16.

An injector 20 that directly injects light oil provided as fuel into the combustion chamber 18 is mounted in the cylinder head 16. The diesel engine 10 in the present embodiment is a compression ignition type of multicylinder engine, such that autoignition of fuel jetted from the injector 20 is caused in the combustion chamber 18 in a compressing state. The diesel engine 10 may alternatively be a single-cylinder engine. An in-cylinder pressure sensor (hereinafter referred to as "CPS") 22 is also mounted in the cylinder head 16, The injector 20 and the CPS 22 are provided on each combustion chamber 18.

The system in the present embodiment is provided with an electronic control unit (ECU) 30. The CPS 22 and other various sensors necessary for control of the diesel engine 10 (e.g., a crank angle sensor for detecting the engine speed, an air flow meter for detecting the amount of intake air and a temperature sensor for detecting the engine temperature) are electrically connected to the input side of the ECU 30. On the other hand, various actuators including the injector 20 are electrically connected to the output side of the ECU 30. The ECU 30 operates the various actuators by executing predetermined programs on the basis of input information from the various sensors. The ECU 30 thereby executes various kinds of control relating to the operation of the diesel engine 10, including at-start control and decomposing heating control described below.

Description of CPS 22

Figure 2:
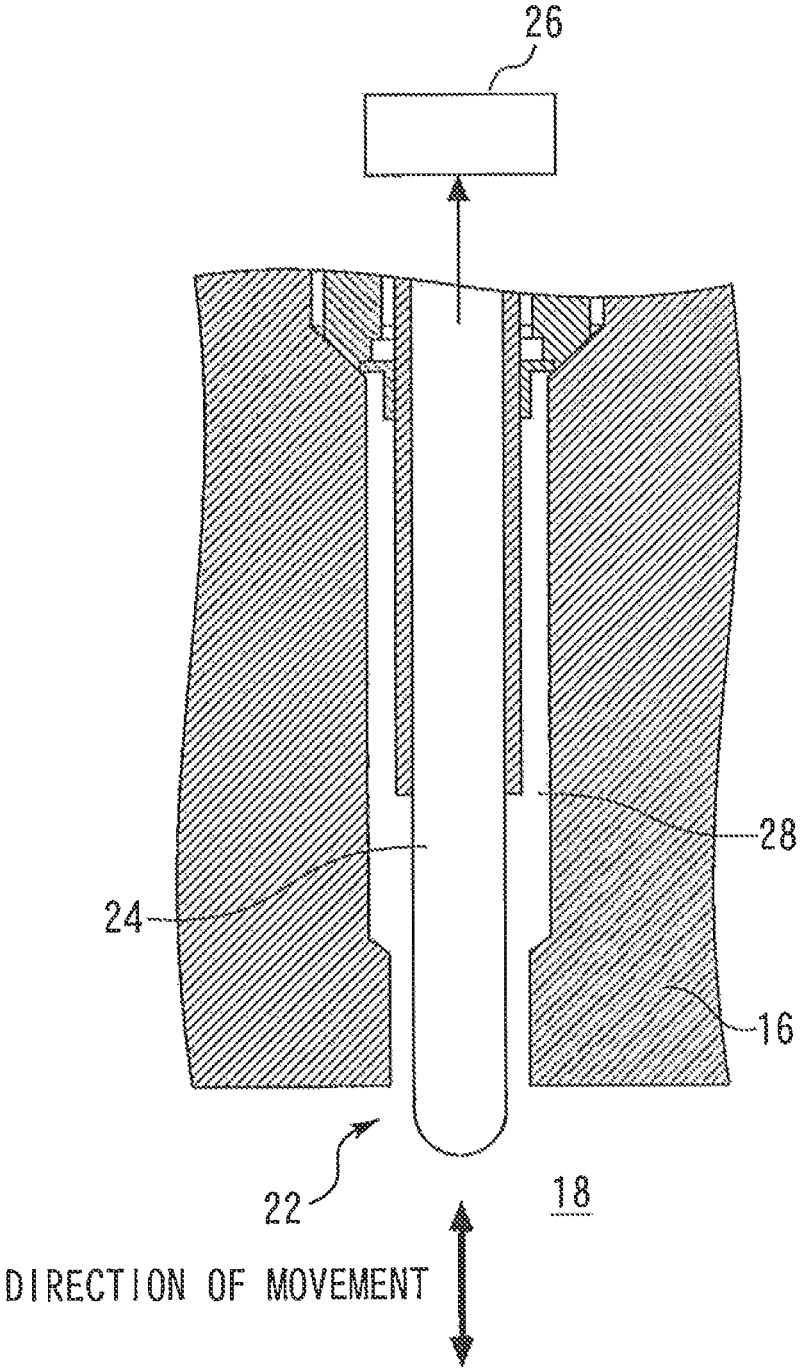
FIG. 2 is a diagram showing a tip end portion of a CPS and a portion on the periphery of the tip end portion.

FIG. 2 is a diagram showing a tip end portion of the CPS 22 and a portion on the periphery of the tip end portion. As shown in FIG. 2, the CPS 22 includes a heater 24 in rod form serving as a pressure receiving part, and a sensing part 26. The CPS 22 is inserted in a glow hole (threaded hole) 28 formed in the cylinder head 16. The heater 24 projects at its tip end side into the combustion chamber 18 and is fixed on the cylinder head 16 at is proximal end side. The sensing part 26 is electrically connected to the heater 24 through a middle shaft (not illustrated) and is also connected electrically to the ECU 30.

The CPS 22 is an in-cylinder pressure sensor integrated with a glow plug. The heater 24 is constructed so as to be movable in directions along its axis (directions indicated by arrows in FIG. 2). When the heater 24 receives the pressure in the combustion chamber 18 (hereinafter referred to as "in-cylinder pressure"), the heater 24 moves along its axial direction according to the pressure. The sensing part 26 is arranged to detect the amount of displacement of the heater 24 and the middle shaft. For example, as sensing part 26, a piezoelectric element that generates electricity according the amount of displacement or a strain gage for measuring the amount of displacement as an amount of strain is used. The amount of displacement detected with the sensing part 26 corresponds to the in-cylinder pressure and is transmitted to the ECU 30.

The CPS 22 functions as a glow plug, for example, when a heat generating element (not illustrated) incorporated in the tip end portion of the heater 24 is energized. When the heat generating element is energized, the heater 24 is heated (glow heated), thereby increasing the temperature around the heater 24. The kinds of control on the heat generating element includes at-start control. At the time of starting the engine, there is a possibility of failure to reach the ignition temperature by compressing air in the combustion chamber 18, since the engine water temperature is low and the temperature in the combustion chamber 18 is also low. At-start control is control performed to avoid this failure. In at-start control, the amount of energization of the heat generating element is controlled so that the temperature of the heater 24 is in a temperature region necessary for ignition (at least equal to or higher than 1000° C.).

Features of First Embodiment

In some cases, unburned fuel (hereinafter referred to as "unburned HC") and soot are generated when light oil is burned in the combustion chamber 18. Generated unburned HC and soot are ordinarily discharged from the combustion chamber 18. However, there is a possibility of part of the generated unburned HC and soot remaining in the combustion chamber 18 and attaching to the inner wall surface of the combustion chamber 18. There is also a possibility of part of the generated unburned HC and soot attaching to the inner circumferential wall surface of the glow hole 28. This is due to the structure in which the combustion chamber 18 and the glow hole 28 communicate with each other. There is a possibility of the attached unburned HC and soot accumulating by changing into a deposit.

In particular, when a deposit is accumulated on the inner circumferential wall surface of the glow hole 28, resistance occurs to sliding of the heater 24 serving as a pressure receiving part and the detection accuracy of the CPS 22 functioning as a pressure sensor is reduced. In the present embodiment, therefore, decomposing heating control is performed for the purpose of decomposing and removing the deposit accumulated on the inner circumferential surface of the glow hole 28, independently of the at-start control. In decomposing heating control, the amount of energization of the heat generating element is controlled so that the temperature around the heater 24 is in or above a first temperature region from 500° C. to 700° C. (while the temperature of the heater 24 is set lower than 1000° C.).

Figure 3:
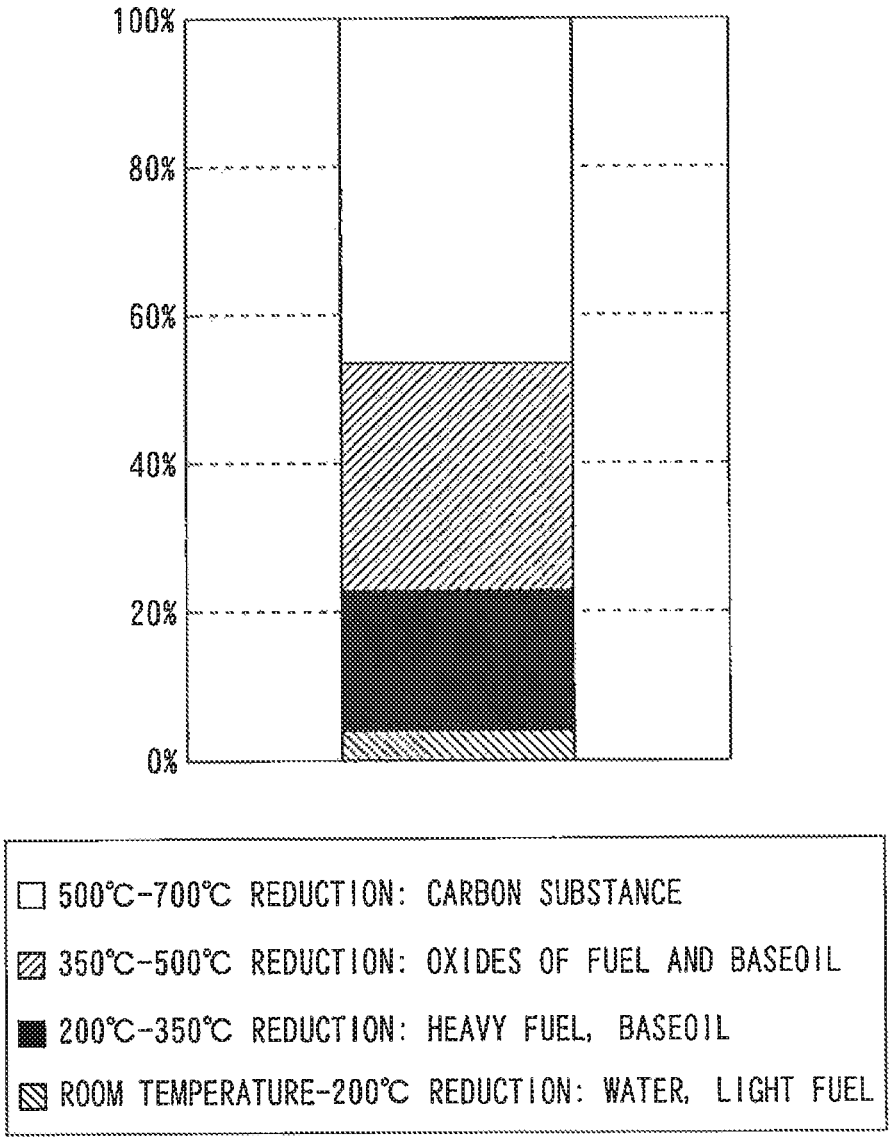
FIG. 3 is a diagram showing proportions of the constituents of a deposit.

Decomposing heating control is performed when the amount of deposit accumulated on the inner circumferential wall surface of the glow hole 28 (hereinafter referred to as "deposit amount $M_{DEP}$") is equal to or larger than a threshold value. The deposit amount $M_{DEP}$ is estimated on the basis of a finding made by the inventors of the present invention. This finding will be described with reference to FIG. 3. FIG. 3 is a diagram showing the proportions of the constituents of a deposit. This diagram was prepared on the basis of the results of thermogravimetry-differential thermal analysis (TG-DTA) with respect to a deposit at an initial stage. As shown in FIG. 3, a reduction in amount from room temperature to 200° C. corresponds to water and light fuel; a reduction in amount from 200° C. to 350° C., to heavy fuel and baseoil in engine oil; a reduction in amount from 500° C. to 700° C., to a carbon substance; and a reduction in amount from the remaining temperature region, i.e., a region from 350° C. to 500° C., to oxides of the fuel and the baseoil.

From the results shown in FIG. 3, it can be understood that the deposit has, as its major constituents, constituents derived from unburned HC (i.e., light fuel, heavy fuel and oxides of fuel) and a constituent derived from soot (i.e., a carbon substance). The amount of engine oil existing in the combustion chamber is ordinarily smaller than that of unburned HC. Therefore, as shown in FIG. 3, most of the reduction in amount from 200° C. to 350° C. is thought to be derived from the fuel and most of the reduction in amount from 350° C. to 500° C. is thought to be derived from oxides of the fuel. Then, from the results shown in FIG. 3, it can be understood that the mass of the constituents derived from unburned HC and the mass of the constituent derived from soot are approximately equal to each other. The inventors of the present invention confirmed that the ratio of the mass of constituents of a deposit derived from unburned HC and the mass of a constituent of the deposit derived from soot is approximately 1:1, although it varied slightly depending on the condition of operation of the engine and peripheral environmental factors.

Estimation of the deposit amount $M_{DEP}$ based on the above-described finding is performed as concretely described below. First, an amount $m_{SOOT}$ of soot and an amount $m_{HC}$ of unburned HC generated in the combustion chamber 18 are computed in each engine cycle. Subsequently, the amount $m_{SOOT}$ of soot and the amount $m_{HC}$, of unburned HC thereby computed are added to the amount $m_{SOOT}$ of soot and the amount $m_{HC}$ of unburned HC last computed in the preceding cycle, thereby computing an integrated amount $M_{SOOT}$ and an integrated amount $M_{HC}$. Next, the larger one of the integrated amounts is reduced to the value equal to the smaller one so that the ratio in mass of the amount $m_{SOOT}$ of soot and the amount $m_{HC}$ of unburned HC computed is 1:1, and the deposit amount $M_{DEP}$ is obtained. This mass adjustment is performed at constant time intervals. It is assumed that computation equations, maps or the like used to compute the amount $m_{SOOT}$ of soot and the amount $m_{HC}$ of unburned HC are stored in the ECU 30 in advance, and that the time interval at which mass adjustment is performed is stored in the ECU 30 in advance.

The above-described finding is based on the results of actual analysis of a deposit. It can therefore be said that the deposit amount $M_{DEP}$ obtained on the basis of the above-described finding exactly expresses the amount of deposit accumulated on the inner circumferential wall surface of the glow hole 28. Thus, in the present embodiment, decomposing heating control can be performed at an optimum time. That is, the power consumption for execution of decomposing heating control can be minimized.

Concrete Processing

Figure 4:
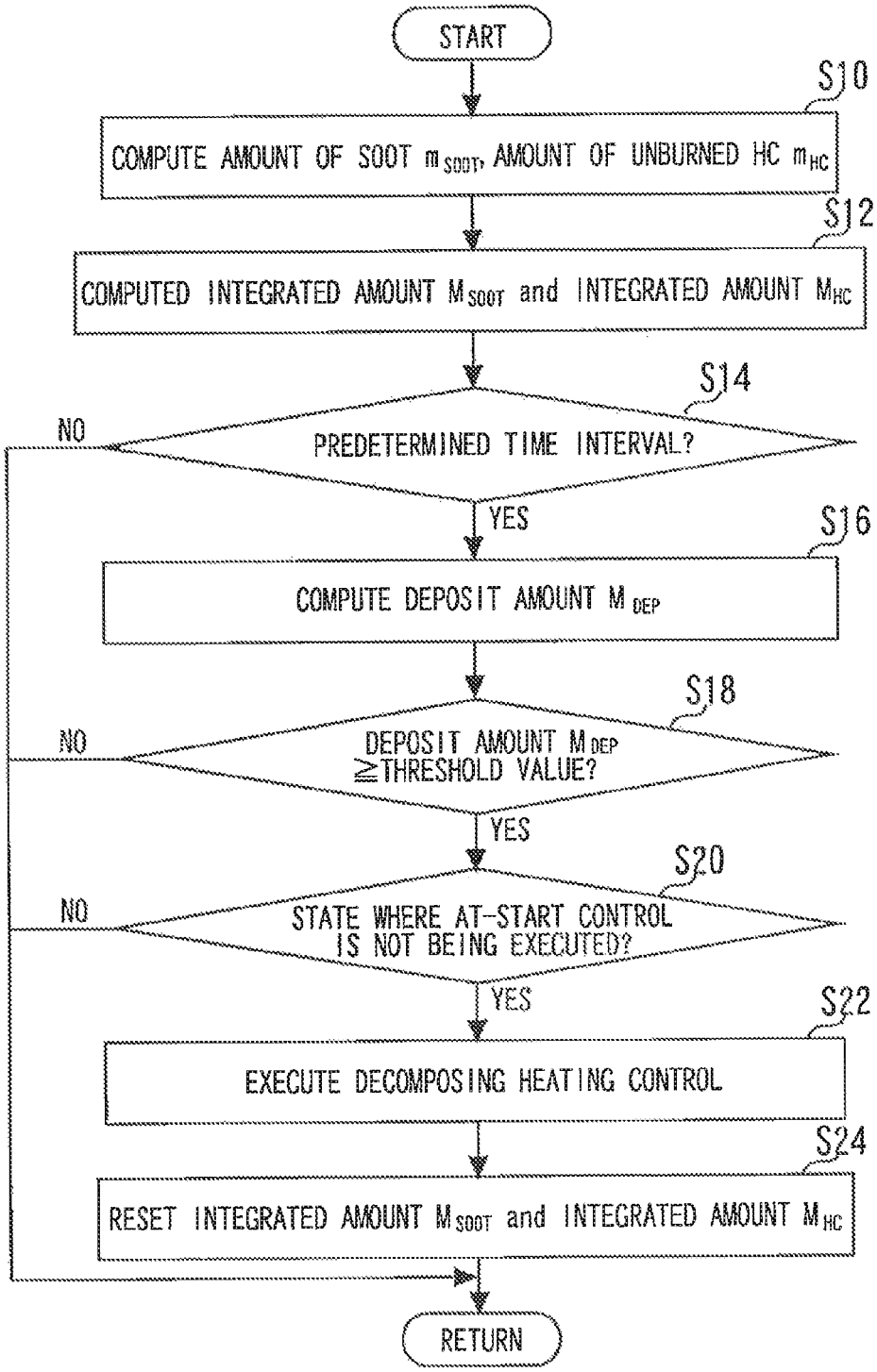
FIG. 4 is a flowchart showing an energization control routine executed by an ECU in the first embodiment.

Concrete processing for realizing the above-described function will be described with reference to FIG. 4. FIG. 4 is a flowchart showing an energization control routine executed by the ECU 30 in the first embodiment. It is assumed that the routine shown in FIG. 4 is periodically executed repeatedly immediately after the diesel engine 10 is started.

In the routine shown in FIG. 4, the amount $m_{SOOT}$ of soot and the amount $m_{HC}$ of unburned HC generated in the combustion chamber 18 are first computed (step S10). The amount $m_{SOOT}$ of soot and the amount $m_{HC}$ of unburned HC are computed in each cycle on the basis of the computation equation or the map stored in the ECU 30 and the condition of combustion in the combustion chamber 18 (or the condition of operation of the diesel engine 10).

Subsequently, the integrated amount $M_{SOOT}$ and the integrated amount $M_{HC}$ are computed (step S12). More specifically, the amount $m_{SOOT}$ of soot and the amount $m_{HC}$ of unburned HC computed in step S10 are added to the integrated amount $M_{SOOT}$ and the integrated amount $M_{HC}$ computed in the preceding execution of the routine. The computed integrated amount $M_{SOOT}$ and integrated amount $M_{HC}$ are recorded in the ECU 30 for computation in the subsequent execution of the routine.

Subsequently, determination is made as to whether or not the lapse of time after the start of computation of the amount $m_{SOOT}$ of soot and the amount $m_{HC}$ of unburned HC equal to an integer multiple of a predetermined time interval (step S14). This lapse of time is, for example, the lapse of time after processing in step 24 described below. As the predetermined time interval, a value stored in the ECU 30 is used. If the lapse of time is not equal to the integer multiple of the predetermined time interval, the present routine is ended. If the lapse of time is equal to the integer multiple of the predetermined time interval, it can be determined that there is a need to perform mass adjustment of the integrated amount $M_{SOOT}$ or the integrated amount $M_{HC}$, and the process therefore advances to step S16.

In step S16, the deposit amount $M_{DEP}$ is computed. More specifically, the integrated amount $M_{SOOT}$ and the integrated amount $M_{HC}$ obtained in step S12 are first compared with each other. Subsequently, the larger one of the integrated amount $M_{SOOT}$ and the integrated amount $M_{HC}$ is reduced so that the mass ratio of the integrated amount $M_{SOOT}$ and the integrated amount $M_{HC}$ is 1:1, and the deposit amount $M_{DEP}$ is computed. In other words, the deposit amount $M_{DEP}$ is obtained by doubling the smaller one of the integrated amount $M_{SOOT}$ and the integrated amount $M_{HC}$.

Subsequently, determination is made as to whether or not the deposit amount $M_{DEP}$ is equal to or larger than a threshold value (step S18). It is assumed that threshold value used in this step is set in advance as an estimated value not influencing the heating power of the heater 24 and the sensor function of the CPS 22 and stored in the ECU 30. If the deposit amount $M_{DEP}$ is smaller than the threshold value, it can be determined that there is no need to perform decomposing heating control, and the present routine is therefore ended. If the deposit amount $M_{DEP}$ is equal to or larger than the threshold value, the process advances to step S20.

In step S20, determination is made as to whether or not at-start control is being executed. The CPS 22 is originally intended for use as a glow plug in at-start control. Accordingly, if it is determined that at-start control is being executed, the present routine is ended in order that at-start control be performed with priority. If it is determined that at-start control is not being executed, decomposing heating control is executed (step S22). Decomposing heating control is performed for a predetermined time period. The integrated amount $M_{SOOT}$ and the integrated amount $M_{HC}$ recorded in the ECU 30 are thereafter reset (step S24) and the present routine is ended.

Thus, with the routine shown in FIG. 4, the amount of deposit accumulated on the inner circumferential end surface of the glow hole 28 can be estimated with high accuracy. Decomposing heating control can therefore be performed at an optimum time. That is, the power consumption for execution of decomposing heating control can be minimized.

In the above-described first embodiment, the amount $m_{SOOT}$ of soot and the amount $m_{HC}$ of unburned HC generated in the combustion chamber 18 are computed separately from each other. However, the process may alternatively be such that only the amount $m_{HC}$ of unburned HC is computed and a value obtained by multiplying the computed amount $m_{HC}$ of unburned HC by a coefficient according to the condition of combustion in the combustion chamber 18 (or the condition of operation of the diesel engine 10) is used as the amount $m_{SOOT}$ of soot. The method of computing the amount $m_{SOOT}$ of soot and the amount $m_{HC}$ of unburned HC can thus be modified variously. This modification example can also be applied to embodiments described below.

In the above-described first embodiment, comparison between the integrated amount $M_{SOOT}$ and the integrated amount $M_{HC}$ is made at constant time intervals. However, mass adjustment may be performed by comparing the integrated amount $M_{SOOT}$ and the integrated amount $M_{HC}$ immediately after the computation of the integrated amount $M_{SOOT}$ and the integrated amount $M_{HC}$. That is, step S14 in FIG. 4 may be omitted. This modification example can also be applied to the embodiments described below.

In the above-described first embodiment, the "deposit amount estimation means" in the first aspect of the invention is realized by executing processing from step S10 to step S16 in FIG. 4 and the "energization execution means" in the first aspect of the invention is realized by executing processing from step S18 to step S22 in FIG. 4.

Second Embodiment

A second embodiment of the present invention will be described with reference to FIG. 5. The second embodiment presupposes the system configuration shown in FIG. 1 and the description of the system configuration will not be repeated.

Feature of Second Embodiment

In the above-described first embodiment, the deposit amount $M_{DEP}$ is estimated by assuming that unburned HC and soot generated in the combustion chamber form a deposit at a mass ratio of 1:1. In the second embodiment, the deposit amount $M_{DEP}$ is estimated on the basis of another finding made by the inventors of the present invention. This finding will be described with reference to FIG. 5. FIG. 5 is a diagram showing changes in sensitivity (output) of the CPS. This diagram was prepared on the basis of the results of an endurance test carried out by alternately repeating a normal operation and an operation in which unburned HC and smoke were generated. In this endurance test, the concentrations of unburned HC and smoke generated were changed. In part (a) of FIG. 5 corresponds to the results when the smoke concentration was 1.0 FSN; in part (b) of FIG. 5, to the results when the unburned HC concentration was 1100 ppm and the smoke concentration was 0.1 FSN; and in part (c) of FIG. 5, to the results when the unburned HC concentration was 1100 ppm and the smoke concentration was 1.0 FSN.

Figure 5:
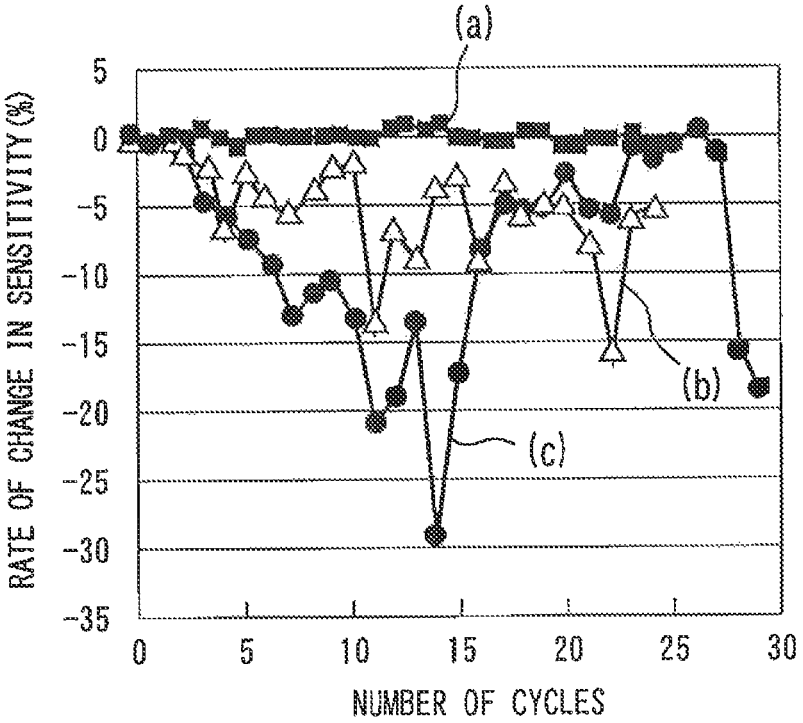
FIG. 5 is a diagram showing changes in sensitivity (output) of the CPS.

When only smoke was generated, the sensor sensitivity was not substantially changed from the initial value (the sensor sensitivity when the number of cycles was zero), as shown in part (a) of FIG. 5. On the other hand, the number of times the sensor sensitivity became equal to or lower than the initial value was increased when both smoke and unburned HC were generated, as shown in part (b) or part (c) of FIG. 5. From these results, it can be understood that no deposit is formed when only smoke is generated, and that a deposit is formed in the presence of unburned HC and smoke existing simultaneously. The inventors of the present invention conjecture that when constituent particles of smoke (i.e., soot) and unburned HC coexist, a substance corresponding to a precursor of a deposit is formed on the soot existing as nuclei. Also, as can be understood comparison between part (b) and part (c) of FIG. 5, the degree of reduction in sensor sensitivity becomes higher if the smoke concentration is increased when the unburned HC concentration condition is fixed. From this result, it can also be understood that while the coexistence of smoke and unburned HC is a prerequisite, unburned HC contributes largely to the formation of a deposit.

Estimation of the deposit amount $M_{DEP}$ based on the above-described finding is performed as concretely described below. First, the amount $m_{SOOT}$ of soot and the amount $m_{HC}$ of unburned HC generated in the combustion chamber 18 are computed in each engine cycle. Subsequently, the amount $m_{SOOT}$ of soot and the amount $m_{HC}$ of unburned HC thereby computed are added to the amount $m_{SOOT}$ of soot and the amount $m_{HC}$ of unburned HC last computed in the preceding cycle, thereby computing the integrated amount $M_{SOOT}$ and the integrated amount $M_{HC}$. Next, the integrated amount $M_{SOOT}$ is adjusted so that the proportion $R_{SOOT}$ of the integrated amount $M_{SOOT}$ in a total mass $M_{TOTAL}$, i.e., the sum of the computed integrated amounts $M_{SOOT}$ and $M_{HC}$, is equal to or smaller than 50%, and the deposit amount $M_{DEP}$ is obtained. If the proportion $R_{SOOT}$ is equal to or smaller than 50%, the total mass $M_{TOTAL}$ is obtained as deposit amount $M_{DEP}$ without adjusting the integrated amount $M_{SOOT}$, If the proportion $R_{SOOT}$ exceeds 50%, the integrated amount $M_{SOOT}$ is adjusted so that the proportion $R_{SOOT}$ is 50%, and the deposit amount $M_{DEP}$ is obtained by adding together the adjusted integrated amount $M_{SOOT}$ and the computed integrated amount $M_{HC}$. The reason for selecting this value of the proportion $R_{SOOT}$ is because unburned HC contributes largely to the formation of a deposit as described above with reference to FIG. 5. Adjustment of the integrated amount $M_{SOOT}$ is performed at constant time intervals. It is assumed that a computation equation, a map or the like used to compute the integrated amount $M_{SOOT}$ is stored in the ECU 30 in advance, and that the time interval at which adjustment of integrated amount $M_{SOOT}$ is performed is stored in the ECU 30 in advance.

The above-described finding was obtained on the basis of the results of an endurance test carried out by actually burning in the combustion chamber unburned HC and soot that are major constituents of a deposit. It can therefore be said that the deposit amount $M_{DEP}$ obtained on the basis of the above-described finding exactly expresses the amount of deposit accumulated on the inner circumferential wall surface of the glow hole 28. Thus, the present embodiment can have the same advantage as that of the first embodiment.

Concrete processing in the present embodiment is defined by replacing mass ratio adjustment in step S16 in FIG. 4 with the above-described adjustment of the integrated amount $M_{SOOT}$. A routine in FIG. 7 should be referred to, if necessary.

Third Embodiment

Figure 6:
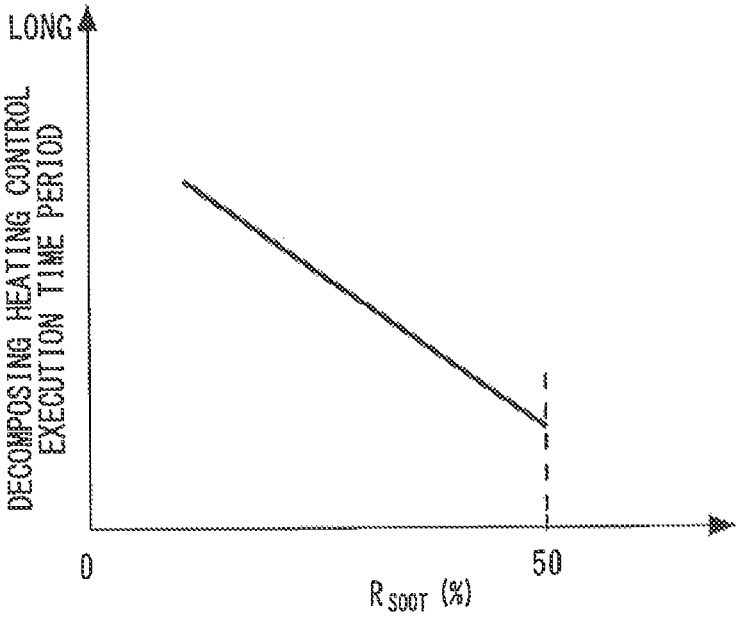
FIG. 6 is a diagram showing the relationship between a decomposing heating control execution time period and a proportion $R_{SOOT}$.

A third Embodiment of the present invention will subsequently be described with reference to FIGS. 6 and 7. The third embodiment presupposes estimation of the deposit amount $M_{DEP}$ described above in the description of the second embodiment, and a redundant description of estimation of the deposit amount $M_{DEP}$ is avoided.

Feature of Third Embodiment

As already described with reference to FIG. 3, constituents of a deposit derived from unburned HC are decomposed in a temperature region from room temperature to 500° C. when the deposit is decomposed. Also, as already described with reference to FIG. 5, no deposit is formed when only soot exists in the combustion chamber, and a substance corresponding to a precursor of a deposit is formed on soot existing as nuclei when the soot and unburned HC coexist. Therefore, if the temperature around the heater 24 is increased into a second temperature region from room temperature to 500° C. by performing decomposing heating control, unburned HC in a deposit accumulated on the inner circumferential wall surface of the glow hole 28 can be decomposed and soot forming the nuclei of the deposit can be separated from the inner circumferential wall surface. A deposit at an initial stage of accumulation in particular has a higher proportion of constituents derived from HC and has a lower decomposition temperature, and separation of such a deposit can be promoted at a lower temperature setting.

In the above-described second embodiment, the integrated amount $M_{SOOT}$ is adjusted so that the proportion $R_{SOT}$ of the integrated amount $M_{SOOT}$ in the total mass $MT_{TOTAL}$, i.e., the sum of the computed integrated amounts $M_{SOOT}$ and $M_{HC}$, is equal to or smaller than 50%. Accordingly, the adjusted proportion $R_{SOOT}$ can have any value satisfying $0\% < R_{SOOT} \leq 50\%$, Conversely, the proportion $R_{HC}$ of the integrated amount $M_{HC}$ in the total mass $M_{TOTAL}$ after adjustment can have any value satisfying $50\% \leq R_{HC} < 100\%$.

If the proportion $R_{HC}$ is increased, the difficulty in decomposing constituents in deposit derived from unburned HC is increased. Therefore, if the proportion $R_{HC}$ is increased, supply of a larger amount of energy is needed during decomposing heating control to decompose unburned HC in deposit. In the present embodiment, therefore, the time period during which decomposing heating control is executed (the time period during which the heat generating element is energized) is changed according to the proportion $R_{SOOT}$. FIG. 6 is a diagram showing the relationship between the decomposing heating control execution time period and the proportion $R_{SOOT}$. The execution time period is shortened if the proportion $R_{SOOT}$ is increased, as shown in FIG. 6. That is, the execution time period is extended if the proportion $R_{HC}$ is increased. Constituents derived from unburned HC can thereby be decomposed with reliability, thus enabling removal of a deposit accumulated on the inner circumferential wall surface of the glow hole 28. It is assumed that the relationship shown in FIG. 6 is stored in map form in the ECU 30 in advance.

Concrete Processing

Concrete processing for realizing the above-described function will be described with reference to FIG. 7. FIG. 7 is a flowchart showing an energization control routine executed by the ECU 30 in the third embodiment. It is assumed that the routine shown in FIG. 7 is periodically executed immediately after the diesel engine 10 is started.

Figure 7:
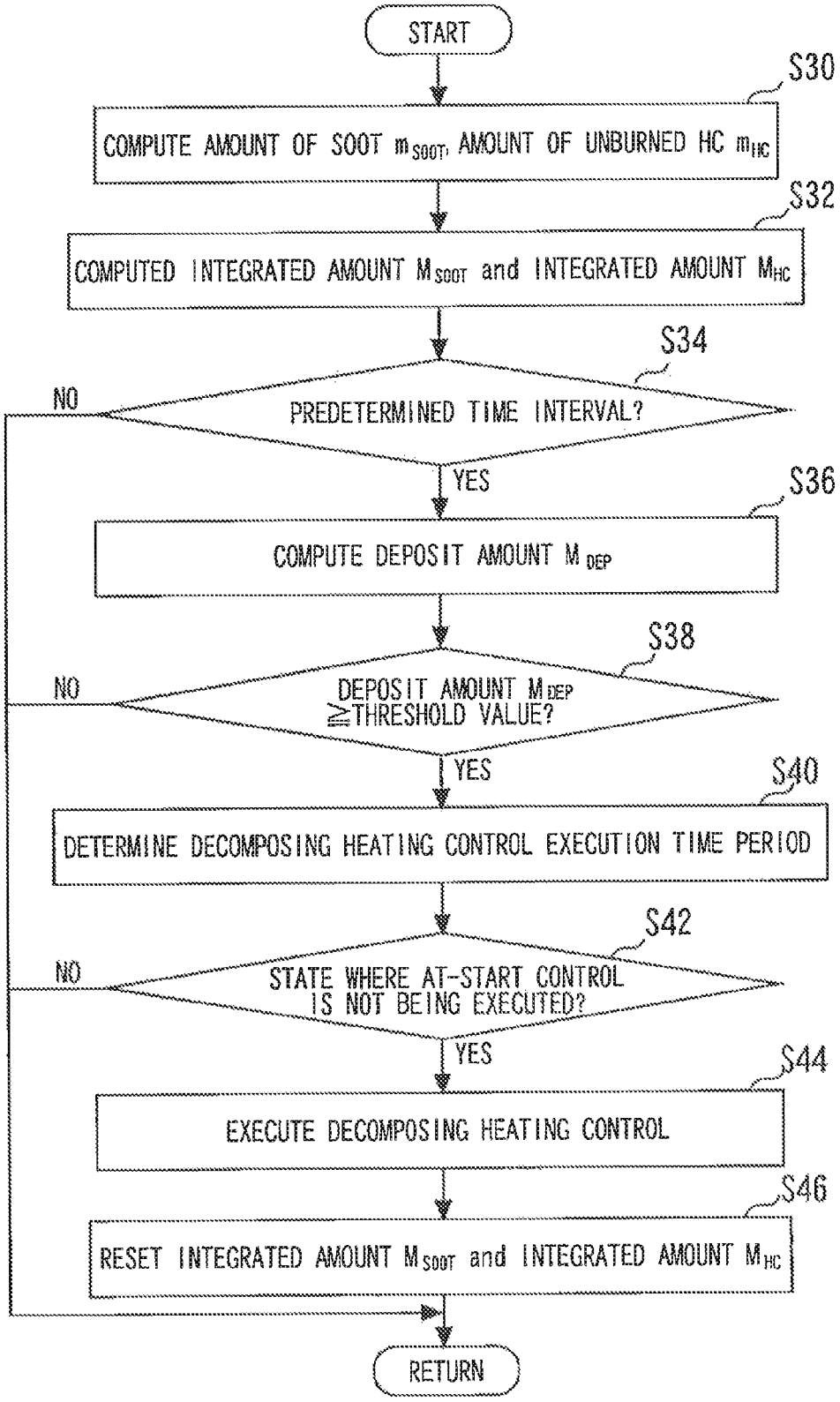
FIG. 7 is a flowchart showing an energization control routine executed by the ECU in the third embodiment.

In the routine shown in FIG. 7, processing in steps S30, S32, and S34 is first executed. Processing in steps S30, S32, and S34 is the same as processing in steps S10, S12, and S14 shown in FIG. 4.

Subsequently to step S34, the deposit amount $M_{DEP}$ is computed (step S36). More specifically, the total mass $M_{TOTAL}$ is computed by adding together the integrated amount $M_{SOOT}$ and the integrated amount $M_{HC}$ computed in step S32. Subsequently, the integrated amount $M_{SOOT}$ is adjusted so that the proportion $R_{SOOT}$ of the integrated amount $M_{SOOT}$ in the total mass $M_{TOTAL}$ is equal to or smaller than 50%, and the deposit amount $M_{DEP}$ is computed.

Subsequently, determination is made as to whether or not the deposit amount $M_{DEP}$ is equal to or larger than a threshold value (step S38). Processing in step S38 is the same as processing in step S18 shown in FIG. 4. If the deposit amount $M_{DEP}$ is equal to or larger than the threshold value, the process advances to step S40.

In step S40, the decomposing heating control execution time period is determined. The execution time period is determined on the basis of a map based on the relationship shown in FIG. 6 and the mass proportion of the integrated amount $M_{SOOT}$ computed in step S36. Processing in steps S42, S44, and S46 is thereafter executed. Processing in steps S42, S44, and S46 is the same as processing in steps from S20, S22, and S24 shown in FIG. 4.

Thus, with the routine shown in FIG. 7, the decomposing heating control execution time period is shortened if the proportion $R_{SOOT}$ of the integrated amount $M_{SOOT}$ in the total mass $M_{TOTAL}$ is increased. That is, decomposing heating control can be executed for a longer time period if the proportion $R_{HC}$ of the integrated amount $M_{HC}$ in the total mass $M_{TOTAL}$ is increased. Therefore, constituents in deposit derived from unburned HC can be decomposed with reliability even when the proportion $R_{HC}$ is large.

While the decomposing heating control execution time period is changed according to the proportion $R_{SOOT}$ in the above-described third embodiment, the target temperature in decomposing heating control may be changed according to the proportion $R_{SOOT}$ in place of the execution time period. Any mode in which the amount of energy for energization is changed during decomposing heating control can be used as an example of modification of the present embodiment. However, there is a need to change the target temperature in the second temperature region since the temperature around the heater 24 is increased into the second temperature region by decomposing heating control.

While the decomposing heating control execution time period is set inversely proportional to the proportion $R_{SOOT}$ in the third embodiment, the method of setting the decomposing heating control execution time period is not limited to this. For example, a first time period is set as the execution time period when the proportion $R_{SOOT}$ is larger than a predetermined value, and a second time period longer than the first time period is set as the execution time period when the proportion $R_{SOOT}$ is smaller than the predetermined value.

In the above-described third embodiment, the "energy amount setting means" in the fourth aspect of the invention is realized by executing processing in step S40 shown in FIG. 7.

The invention claimed is:

1. A device for controlling an in-cylinder pressure sensor integrated with a glow plug for detecting the pressure in a combustion chamber of an internal combustion engine, the sensor having a pressure receiving portion constituted by a heater incorporating a heat generating element, the device comprising:

energization execution means for energizing the heat generating element for the purpose of decomposing and removing an accumulated deposit when the amount of accumulated deposit in the combustion chamber is equal to or larger than a predetermined amount; and deposit amount estimation means for estimating the amount of deposit by computing in each cycle of the internal combustion engine an amount of soot and an amount of unburned fuel generated by combustion in the combustion chamber, and by adjusting one of the computed amount of soot and the computed amount of unburned fuel based on a comparison between the computed amount of soot and the computed amount of unburned fuel.

2. The device according to claim 1, wherein the deposit amount estimation means estimates the amount of deposit by adjusting the one of the computed amount of soot and the computed amount of unburned fuel, when one of the computed amount of soot and the computed amount of unburned fuel is larger in mass than the other one, so that the computed amount of soot and the computed amount of unburned fuel are equal in mass to each other.

3. The device according to claim 1, wherein the deposit amount estimation means estimates the amount of deposit by adjusting the computed amount of soot so that the proportion of soot in the total mass of the computed amount of soot and the computed amount of unburned fuel is equal to or smaller than the proportion of unburned fuel.

4. The device according to claim 3, wherein the energization execution means energizes the heat generating element for the purpose of decomposing and removing unburned fuel in the accumulated deposit, wherein the energization execution means includes energization amount setting means for setting an amount of energization energy to be put into the heat generating element during energization of the heat generating element, and wherein the energization amount setting means sets the amount of energization energy larger when the proportion of soot computed on the basis of the adjusted amount of soot is low than when the proportion of soot is high.

5. An internal combustion engine comprising:

an in-cylinder pressure sensor for detecting the pressure in a combustion chamber of the internal combustion engine, the in-cylinder pressure sensor having a pressure receiving portion constituted by a rod and a sensing part, the sensing part detecting a displacement of the rod, the rod incorporating a heat generating element; and a controller controlling the in-cylinder pressure sensor, the controller programmed to:

(i) compute in each cycle of the internal combustion engine an amount of soot and an amount of unburned fuel generated by combustion in the combustion chamber, (ii) compare the computed amount of soot and the computed amount of unburned fuel, (iii) estimate an amount of accumulated deposit in the combustion chamber by adjusting one of the computed amount of soot and the computed amount of unburned fuel based on the comparison, and (iv) energize the heat generating element when the estimated amount of accumulated deposit is equal to or larger than a predetermined amount.

* * * * *